US006239688B1

(12) United States Patent
Takahashi et al.

(10) Patent No.: US 6,239,688 B1
(45) Date of Patent: May 29, 2001

(54) VARIABLE RESISTOR IN WHICH AN ELECTRODE CONNECTED TO A RESISTOR CAN NOT BE REQUIRED

(75) Inventors: Kisaburo Takahashi; Junichi Kurantani; Toshio Ogawa, all of Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/666,064

(22) Filed: Sep. 19, 2000

(30) Foreign Application Priority Data

Sep. 21, 1999 (JP) ..... 11-266717

(51) Int. Cl.[7] ..... H01C 10/16

(52) U.S. Cl. ..... 338/125; 338/128; 338/130; 338/131; 338/150; 338/137

(58) Field of Search ..... 338/118, 123, 338/125, 137, 150, 152, 160, 128, 130, 131

(56) References Cited

U.S. PATENT DOCUMENTS

| | | | | |
|---|---|---|---|---|
| 3,564,476 | * | 2/1971 | Barden | 338/128 |
| 3,576,510 | * | 4/1971 | Bruder | 338/150 |
| 3,750,078 | * | 7/1973 | Bruder | 338/150 |
| 4,511,879 | * | 4/1985 | Fujii | 338/174 |

FOREIGN PATENT DOCUMENTS 63-42101 2/1988 (JP) .

* cited by examiner

*Primary Examiner*—Karl D. Easthom
(74) *Attorney, Agent, or Firm*—Brinks Hofer Gilson & Lione

(57) ABSTRACT

There is provided a variable resistor comprised of a resistor formed at a movable member arranged to be reciprocatable, and a slider element attached to a fixing member fixed in opposition to the movable member, slidingly contacted with the resistor. The resistor has the first resistor, the second resistor and the third resistor extending in a reciprocating direction of the movable member and electrically independent from each other, a first resistor pattern having one end of each of the first resistor and the second resistor connected to each other, a second resistor pattern having the other ends of the second resistor and the third resistor. The slider element is comprised of the first slider element, the second slider element and the third slider element slidingly contacted with the first resistor, the second resistor and the third resistor. When the movable member is moved in the direction of arrow A, a resistance value between the first and second slider elements is increased and a resistance value between the second slider element and the third slider element is decreased, and in turn when the movable member is moved in a direction of an arrow B, a resistance value between the first slider element and the second slider element is decreased and a resistance value between the second slider element and the third slider element is increased.

4 Claims, 9 Drawing Sheets

VARIABLE RESISTOR IN WHICH AN ELECTRODE CONNECTED TO A RESISTOR CAN NOT BE REQUIRED

BACKGROUND OF THE INVENTION

1. Field of the Invention

This invention relates to a variable resistor in which a movable member formed with a resistor is attached to a fixed member having a slider element fixed thereto in such a way that the movable member can be reciprocated, and further the slider element and the resister are brought into sliding contact with each other.

2. Description of the Prior Art

Referring now to FIGS. 12 to 14, this type of variable resistor of the prior art will be described. This variable resistor is comprised of a cylindrical-formed insulating housing 51 acting as a fixed member; an insulating rotary shaft 52 rotatably stored in the housing 51 and acting as a movable member having an engaging part 52*a* in at least one end thereof to be engaged with a screw driver or the like; a flexible insulating sheet 53 wound around the rotary shaft 52 within the housing 51; a resistance circuit 54 formed at this flexible insulating sheet 53; a slider element 55 attached to the housing 51 is in sliding contact with the resistance circuit 54; and a connecting terminal 56 connected to the slider element 55.

FIG. 13 is a development view for showing the flexible insulating sheet 53 and the resistance circuit 54 arranged in the flexible insulating sheet. FIG. 14 is a sectional view taken along line 14—14 of FIG. 13, wherein the resistance circuit 54 is comprised of one resistor 54*a* and two electrodes 54*b*, 54*c* extending in parallel with a circumferential direction of the rotary shaft 52, and they are connected to each other in series with the resistor 54*a* being an intermediate one of them. The slider element 55 is comprised of three slider elements 55*a*, 55*b*, 55*c* of which extremity ends are in sliding contact with the resistor 54*a* and the electrodes 54*b*, 54*c*, respectively, and the connecting terminal 56 is comprised of three connecting terminals 56*a*, 56*b*, 56*c* each of which is electrically connected to the slider elements 55*a*, 55*b*, 55*c*, respectively.

The variable resistor constructed as described above is constituted such that when the rotary shaft 52 is turned by a screw driver and the like under a state in which a predetermined voltage is applied between the slider elements 55*b*, 55*c* through the connector terminals 56*b*, 56*c*, the resistance circuit 54 wound around the rotary shaft 52 is rotationally moved in respect to the slider elements 55*a*, 55*b*, 55*c* and then the sliding contact positions of the slider elements 55*a*, 55*b*, 55*c* on the resistor 54*a* and the electrodes 54*b*, 54*c* are changed. With such an arrangement as above, a resistance value (a voltage value) between the slider elements 55*a*, 55*b* and a resistance value (a voltage value) between the slider elements 55*a*, 55*c* are changed, an electrical signal (a voltage signal) corresponding to a rotation of the rotary shaft 52 is taken out of the connecting terminal 56*a* through the slider element 55*a*.

Then, in the case that the resistance circuit 54 is formed on the flexible insulating sheet 53, it is necessary to provide two steps: an electrode forming step and a resistor forming step, wherein at first, at the electrode forming step, the electrodes 54*b*, 54*c* such as a silver foil or a copper foil and the like are adhered by vapor deposition or adhered with adhesive agent, then the resistor 54*a* such as a beryllium foil, nichrome foil and tungsten foil or the like is adhered by vapor deposition or adhered with adhesive agent to form the resistance circuit 54.

However, in the case of the prior art variable resistor described above, the slider elements 55*a*, 55*b*, 55*c* fixed to the housing 51 slide on the resistor 54*a* and the electrodes 54*b*, 54*c* wound around the rotary shaft 52 under a rotation of the rotary shaft 52. Due to this fact, the prior art needs not only a troublesome step for forming the electrodes 54*b*, 54*c*, but also requires the electrode forming step and the resistor forming step, resulting in that an entire manufacturing step for the variable resistor is extend in addition due to the fact that there is present only one resistor 54*a* and its maximum length merely corresponds to a value of one circumference around the rotary shaft 52, it is not possible to set a rated voltage to high value and so if a high voltage is applied between the slider elements 55*b*, 55*c*, there occurs a problem that the resistor 54*a* is burned.

SUMMARY OF THE INVENTION

This invention has been invented in view of the aforesaid circumstances of the prior art and it is an object of the present invention to provide a variable resistor in which an electrode connected to the resistor is not be required and its rated voltage can be set high.

In order to accomplish the aforesaid object, the variable resistor of the present invention has the major feature that there are provided a resistor formed at a movable member arranged to be reciprocatable and a slider element fixed to a fixing member fixed in opposition to the movable member, slidingly in contact with the resistor to form an electrical signal generating part together with the resistor, the resistor has a first resistor, a second resistor and a third resistor extending in a reciprocating direction of the movable member and electrically independent from each other, a first resistor pattern having one end of each of the first resistor and the second resistor connected to each other, a second resistor pattern having the other end opposite to one end of the third resistor connected to the other end of the second resistor, the slider element is comprised of a first slider element, a second slider element and a third slider element slidingly contacted with the first resistor, the second resistor and the third resistor. The first, second and third slider elements slide on the first, second and third resistors through a reciprocating motion of the movable member. When the movable member moves from one end to the other end of each of the first, second and third resistors, a resistance value between the first and second slider elements is increased and a resistance value between the second slider element and the third slider element is decreased, and in turn when the movable member is moved from the other end to one end of each of the first, second and third resistors, a resistance value between the first slider element and the second slider element is decreased and a resistance value between the second slider element and the third slider element is increased.

Accordingly, since it is not necessary to form the electrodes as found in the prior art, it is possible to simplify a manufacturing stage for the variable resistor and at the same time the length of the resistor can be increased as compared with that of the prior art resistor, resulting in that a rated voltage can be set large. In addition, since the first, second and third resistors and the first and second patterns described above can be formed simultaneously at the same stage by applying a screen printing method, productivity of the variable resistor is improved.

Further, the first and third resistors having the aforesaid constitution are arranged side by side in a direction crossing at a right angle with a reciprocating motion of the movable member and formed in parallel along the second resistor.

Thus, it is possible to reduce a size of the resistor in a reciprocating direction of the movable member and correspondingly to make a small-sized variable resistor.

Further, the first and third resistors in the aforesaid constitution are arranged in opposition to each other while holding the second resistor.

Accordingly, it is possible to reduce a size of the resistor in a reciprocating direction of the movable member and attain a more small-sized variable resistor.

In addition, the first, second and third resistors and the first and second resistor patterns in the aforesaid constitution are integrally formed.

Thus, these elements can be formed once in the same stage, so that productivity of the variable resistor is improved.

DESCRIPTION OF THE PREFERRED EMBODIMENTS

Figure 1:
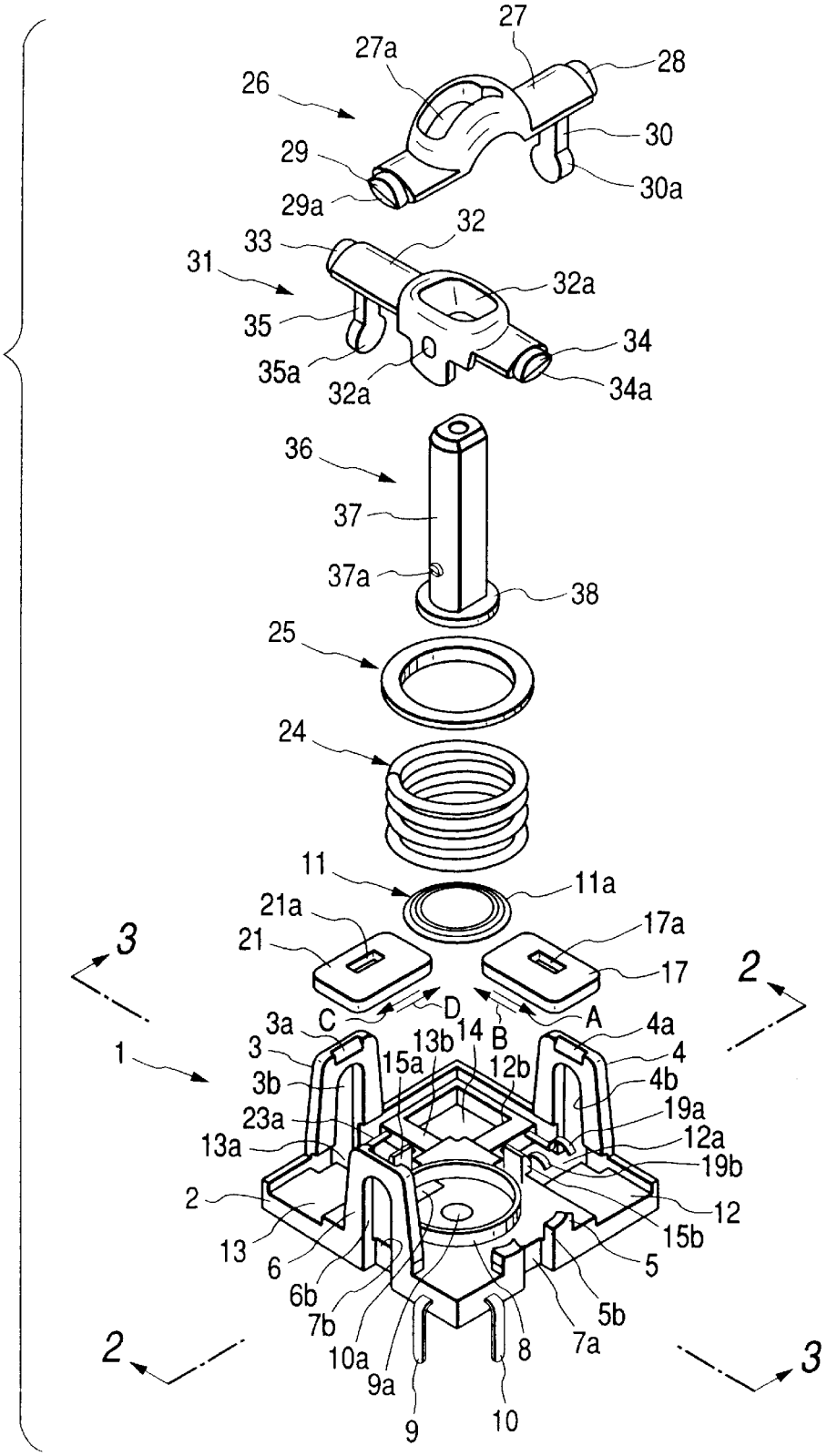
FIG. 1 is an exploded perspective view for showing a variable resistor in the first preferred embodiment of the present invention.

Referring now to FIGS. 1 to 7 of the drawings, the first preferred embodiment of the variable resistor of the present invention will be described as follows.

This variable resistor is comprised of a first cooperating member 26 and a second cooperating member 31 having holes 27*a*, 32*a* at positions overlapped in crossed-state and overlapped from each other; a case 1 acting as a fixed member for supporting each of both ends of the first and second cooperating members 26, 31 and rotatably arranging the first and second cooperating members 26, 31; a lever member 36 supported at this case 1 in such a way that the lever member can be inclined and inserted into holes 27*a*, 32*a* of the first and second cooperating members 26, 31; the first and second resistors 16, 20 for generating a detection signal corresponding to an amount of inclination of the lever member 36; and a return spring 24 or the like for automatically returning the lever member 36 to its initial position, wherein the first and second cooperating members 26, 31 are rotated through an inclining operation of the lever member 36 as described later.

Figure 5:
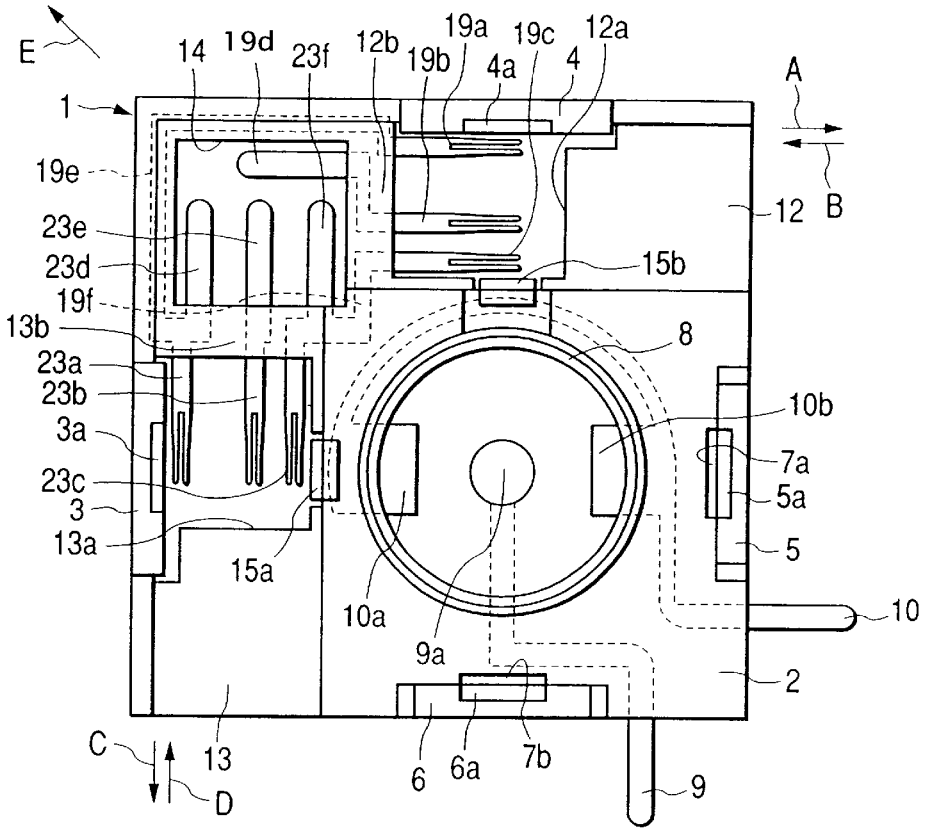
FIG. 5 is a plan view for showing a case in the variable resistor of the first preferred embodiment of the present invention.

The case 1 is made by molding insulating synthetic resin material, has a square-shaped bottom wall 2, and four raised walls 3, 4, 5 and 6 arranged at four sides over the bottom wall 2, and as shown in FIGS. 1 and 5, each of these raised walls 3 to 6 is formed at its inner wall surface with tapered surfaces 3*a*, 4*a*, 5*a*, 6*a* inclined inwardly as they approach a bottom wall 2 from the free extremity ends, and engaging holes 3*b*, 4*b*, 5*b* and 6*b* ranging from the lower sides of the tapered surfaces 3*a* to 6*a* to the bottom wall 2, respectively. In addition, at the bottom wall 2, each of the through holes 7*a*, 7*b* is formed in continuous with the engaging holes 5*b*, 6*b*, and an annular protrusion 8 is formed there and at the same time, a pair of terminals 9, 10 made of conductive metal plates are fixed through insert molding method with their one end being projected outwardly, the other end of a pair of terminals 9, 10 is exposed on the bottom wall 2 within the annular protrusion 8 to form a fixed contact point 9*a* and contact points 10*a*, 10*b*. Then, a dome-like clip spring 11 made of conductive metal thin plate acting as a movable contact point is stored and held within the annular protrusion 8 with its flange 11a being contacted with the contact points 10*a*, 10*b*, respectively, to form a push-button switch.

In addition, the bottom wall 2 is formed with a guide groove 12 extending to partially cut out the fixed end of the raised wall 4 along its one side part, and a guide groove 13 extending along one end of the bottom wall 2 to partially cut out the fixed end of the raised wall 3. Within these guide grooves 12, 13 is formed each of the through holes 12*a*, 13*a* in continuous with each of the engaging holes 4*b*, 3*b*. A square feeding-out hole 14 is formed at one corner where the guide grooves 12, 13 are crossed at a right angle in such a way that each of the segments 12*b*, 13*b* being left between the through holes 12*a*, 13*a*. Then, each of the edges of the guide grooves 12, 13 is formed with each of hooks 15*a*, 15*b* while being opposite to the raised walls 3, 4. (The raised wall 5 in FIG. 1 is shown with its free end being cut out.)

Figure 2:
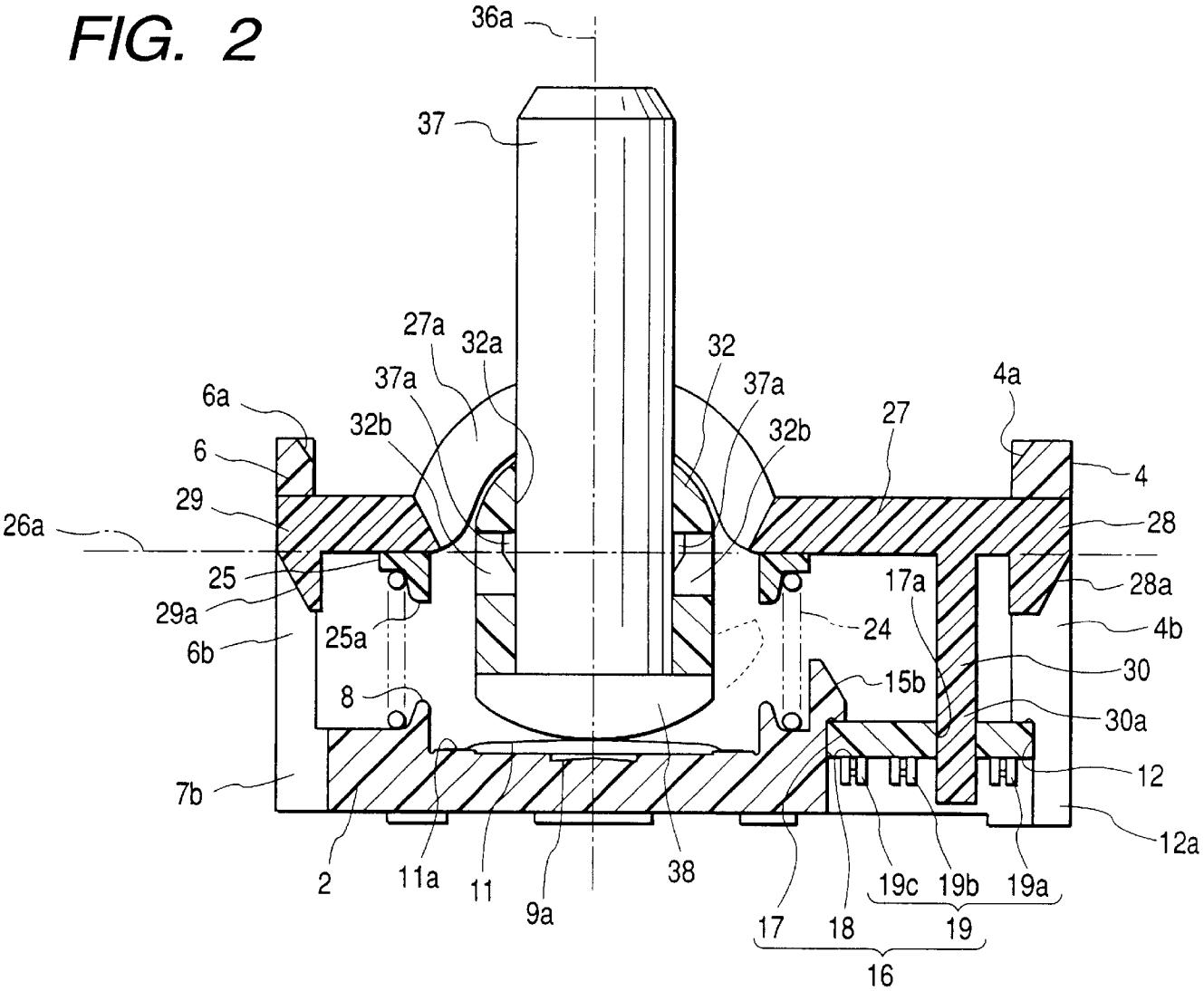
FIG. 2 is a sectional view taken along line 2—2 of FIG. 1.
Figure 6:
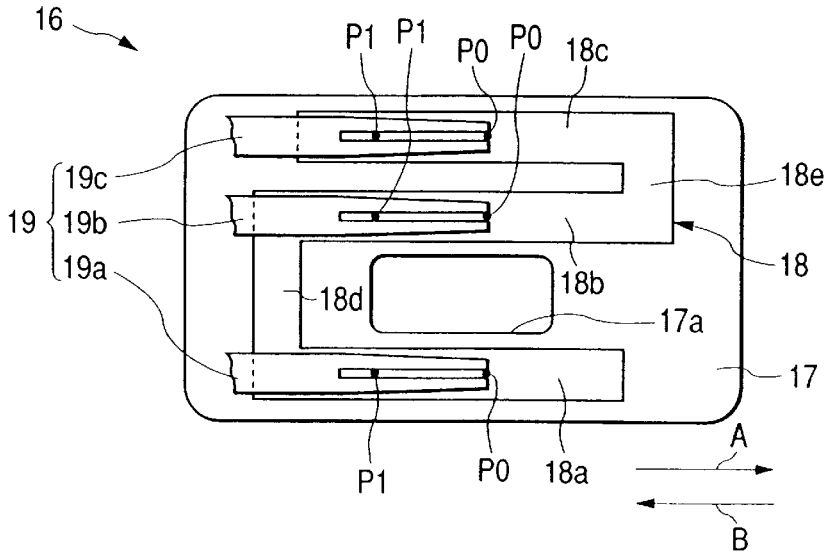
FIG. 6 is a rear view for showing a first resistor of the first preferred embodiment of the present invention.

The first resistor 16 is comprised of a movable member 17 made of insulating synthetic resin such as phenol resin laminated plate or the like formed into a rectangular flat plate; a resistor 18 arranged at the rear surface of the movable member 17 through printing in a zigzag form; and a slider element 19 slidingly contacted with the resistor 18 to form an electrical signal generating part by the resistor 18. The movable member 17 has an engaging hole 17*a*, both sides of it are engaged with the hook part 15*b* and the fixed end of the raised wall 4, and held at the case 1 as shown in FIG. 2, and the movable member can be reciprocated in the directions of arrows A, B shown in FIG. 1 along the guide groove 12. As shown in FIG. 6, the resistor 18 is comprised of a first resistor 18*a*, a second resistor 18*b* and a third resistor 18*c* extending in reciprocating directions (directions of the arrows A and B) of the movable member 17 and electrically independent from each other; a first resistance pattern 18*d* connecting one end of the first resistor 18*a* and one end of second resistor 18*b*, and a second resistance pattern 18*e* connecting the other ends of the second resistor 18*b* and the third resistor 18*c*, wherein these first resistor 18*a*, the second resistor 18*b* and the third resistor 18*c*, the first resistance pattern 18*d* and the second resistance pattern 18*e* are formed to the same width in the same stage by the same carbon paste. Then, the first resistor 18*a* and the third resistor 18*c* are arranged side-by-side in a direction crossing at a right angle with the reciprocating directions of the movable member 17, oppositely faced with the second resistor 18*b* being held therebetween and the first resistor 18*a* and the third resistor 18*c* are formed in parallel along the second resistor 18*b*.

As shown in FIGS. 2, 5 and 6, the slider element 19 is comprised of a first slider element 19*a*, a second slider element 19*b* and a third slider element 19*c* with their extremity ends being projected into the through hole 12*a* and made of conductive thin plate fixed to the segment 12*b* by an insert molding process. Each of the first slider element 19*a*, the second slider element 19*b* and the third slider element 19*c* is slidingly contacted with the first resistor 18*a*, the second resistor 18*b* and the third resistor 18*c*, respectively, and slides on the first resistor 18*a*, the second resistor 18*b* and the third resistor 18*c* under the reciprocating motion of the movable member 17. Then, a terminal 19*d* bent and fed out downwardly from the feeding-out hole 14 is integrally formed at the rear end of the second slider element 19*b* and at the same time, each of the rear ends of the first slider element 19*a* and the third slider element 19*c* is extended to form connecting pieces 19*e*, 19*f*, respectively.

Figure 7:
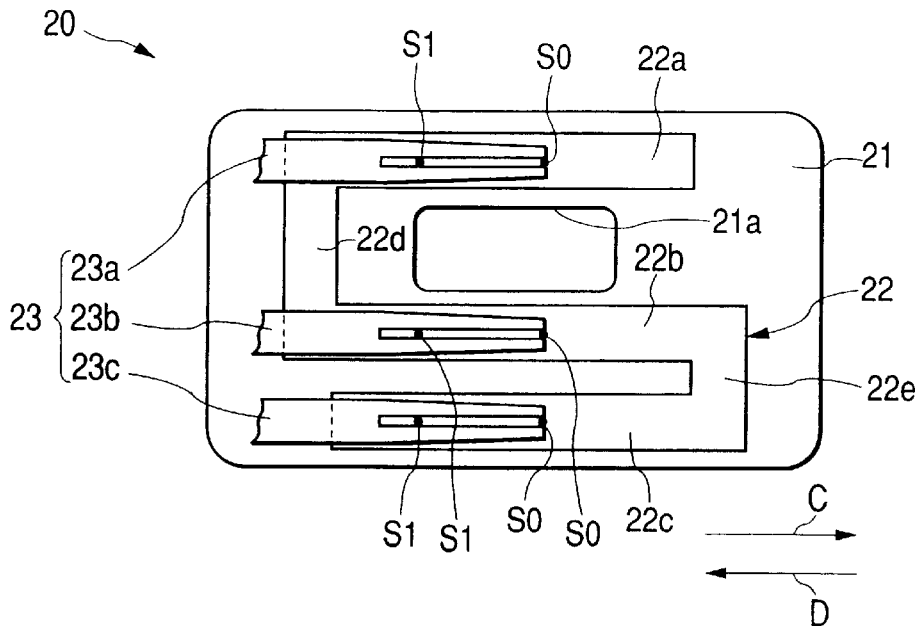
FIG. 7 is a rear view for showing a second resistor of the first preferred embodiment of the present invention.

The second resistor 20 is comprised of a movable member 21 made of insulating synthetic resin and formed into a rectangular flat plate; a resistor 22 arranged at the rear surface of the movable member 21 through printing in a zigzag form; and a slider element 23 slidingly contacted with the resistor 22 to form an electrical signal generating part by the resistor 22. The movable member 21 has an engaging hole 21*a*, both sides of it are engaged with the hook part 15*a* and the fixed end of the raised wall 3, and held at the case 1 as shown in FIG. 2, and the movable member can be reciprocated in the directions of arrows C, D shown in FIG. 1 along the guide groove 13. As shown in FIG. 7, the resistor 22 is comprised of a first resistor 22*a*, a second resistor 22*b* and a third resistor 22*c* extending in reciprocating directions (directions of the arrows C and D) of the movable member 17 and electrically independent from each other; a first resistance pattern 22*d* connecting one end of each of the first resistor 22*a* and the second resistor 22*b* from each other; and a second resistance pattern 22*e* connecting the other end opposite to one end of the third resistor 22*c* to the other end of the second resistor 22*b*, wherein these first resistor 22*a*, the second resistor 22*b* and the third resistor 22*c*, the first resistance pattern 22*d* and the second resistance pattern 22*e* are formed to the same width in the same stage by the same carbon paste. Then, the first resistor 22*a* and the third resistor 22*c* are arranged side-by-side in a direction crossing at a right angle with the reciprocating directions of the movable member 21, oppositely faced with the second resistor 22*b* being held therebetween and the first resistor 22*a* and the third resistor 22*c* are formed in parallel along the second resistor 22*b*.

Figure 3:
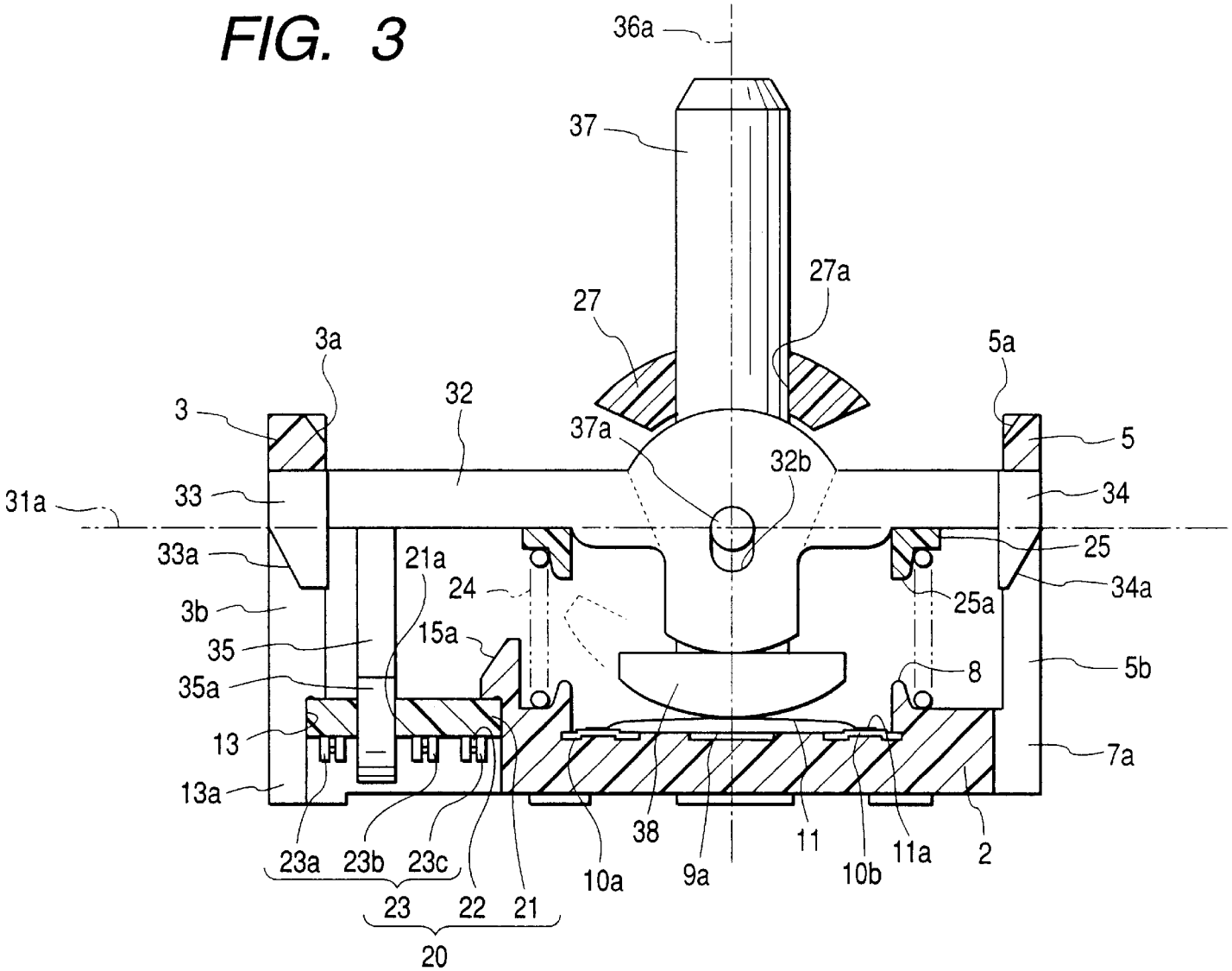
FIG. 3 is a sectional view taken along line 3—3 of FIG. 1.

As shown in FIGS. 3, 5 and 7, the slider element 23 is comprised of a first slider element 23*a*, a second slider element 23*b* and a third slider element 23*c* with their extremity ends being projected into the through hole 13*a* and made of conductive thin plate fixed to the segment 13*b* by an insert molding process. Each of the first slider element 23*a*, the second slider element 23*b* and the third slider element 23*c* is slidingly contacted with the first resistor 22*a*, the second resistor 22*b* and the third resistor 22*c*, respectively, and slides on the first resistor 22*a*, the second resistor 22*b* and the third resistor 22*c* under the reciprocating motion of the movable member 21. Then, terminals 23*d* to 23*f* bent and fed out downwardly from the feeding-out hole 14 are integrally formed at the rear ends of the first to the third slider elements 23*a* to 23*c*, and each of the connecting pieces 19*e*, 19*f* extended from the aforesaid first slider element 19*a* and the third slider element 19*c* is integrally formed with the rear ends of the first slider element 23*a* and the third slider element 23*c*, respectively.

The first slider element 19*a* to the third slider element 19*c* of the first resistor 16, the first slider element 23*a* to the third slider element 23*c* of the second resistor 20, connecting pieces 19*e*, 19*f*, terminal 19*d*, terminals 23*d* to 23*f* and a pair of terminals 9, 10 are punched out and formed in a common conductive thin plate and wound in a loop form under their integrated state, insert molded into the case 1, cut at a predetermined portion and then formed into the aforesaid shape.

A return spring 24 is constituted by a helical coil spring and as shown in FIG. 2, the annular protrusion 8 is fitted to the lower end of the coil spring as shown in FIG. 2 and fixed to the case 1. In addition, a ring-like spring receptacle 25 is supported at the upper end of the return spring 24 while an annular wall 25*a* formed along its inner circumferential edge is being fitted to it.

The first cooperating member 26 is comprised of a semi-column-like base 27 formed with insulating synthetic resin material with its central part being bulged out upwardly, and fixing portions 28, 29 arranged at both ends of the base 27. The bulged-out portion of the base 27 is provided with a hole 27*a* extending in a longitudinal direction of the base 27. The fixing portions 28, 29 are formed with tapered surfaces 28*a*, 29*a* corresponding to the tapered surfaces 4*a*, 6*a* of each of the raised walls 4, 6. In addition, at the position spaced apart from the fixing portion 28 between the fixing portion 28 and the hole 27*a*, the lower surface of the base 27 is integrally arranged with the first arm-like operating part 30 to be suspended, and the extremity end of the first operating part 30 is formed with a circular portion 30*a*. Then, the first cooperating member 26 has the lower surface of the base 27 abutted against the spring receptacle 25, both fixing portions 28, 29 are engaged with the upper ends of the engaging holes 4*b*, 6*b* and they are pivotally arranged at the opposing raised walls 4, 6, and supported at the case 1 and the circular part 30*a* is inserted into and engaged with the engaging hole 17*a* of the movable member 17 in the first resistor 16 without any looseness.

The second cooperating member 31 is comprised of a semi-column-like base 32 formed with insulating synthetic resin material with its central part being bulged out upwardly, and fixing portions 33, 34 arranged at both ends of the base 32. The bulged-out portion of the base 32 is provided with a hole 32*a* extending in a longitudinal direction of the base 32 and an oval fitting hole 32*b* crossing at a right angle with the hole 32*a*. The fixing portions 33, 34 are formed with tapered surfaces 33*a*, 34*a* corresponding to the tapered surfaces 3*a*, 5*a* of each of the raised walls 3, 5. In addition, at the position spaced apart from the fixing portion 33 between the fixing portion 33 and the hole 32*a*, the lower surface of the base 32 is integrally arranged with the second arm-like operating part 35 to be suspended, and the extremity end of the second operating part 35 is formed with a circular portion 35*a*. Then, the second cooperating member 31 has the lower surface of the base 32 abutted against the spring receptacle 25, both fixing portions 33, 34 are engaged with the upper ends of the engaging holes 3*b*, 5*b* and they are pivotally arranged at the opposing raised walls 3, 5, and supported at the case 1 under a state in which it is overlapped with the first cooperating member 26 in a crossed manner, the holes 27*a*, 32*a* are opposed to each other at their overlapped portions, and the circular part 35*a* is inserted into and engaged with the engaging hole 21*a* of the movable member 21 in the second resistor 20 without any looseness.

The lever member 36 is molded by forming insulating synthetic resin material, and this is comprised of a column-like shaft 37 and a pressing part 38 integrally arranged at the lower end of the shaft 37. An outer wall surface of the shaft 37 is formed with a pair of protrusions 37*a*. Then, the lever member 36 is operated such that the shaft 37 is inserted through holes 27*a*, 32*a* of the first cooperating member 26 and the second cooperating member 31, a pair of protrusions 37*a* are engaged with the fitting holes 32*b* of the second cooperating member 31 and snap stopped there, thereby they are supported at the case 1 through the second cooperating member 31 in such a way that it can be inclined, the pressing part 38 is positioned in an annular protrusion 8 abutted against the clip spring 11 and a pair of protrusions 37*a* are positioned at the upper end of the fitting hole 32*b*.

Then, a method for assembling the variable resistor constituted as described above will be described. Both mask and carbon paste corresponding to the zigzag shape of the resistor 16 are used in advance to form the first resistor 18*a*, the second resistor 18*b* and the third resistor 18*c* as well as the first resistance pattern 18*d* and the second resistance pattern 18*e* simultaneously at the rear surface of the movable member 17 at the same stage by a screen printing and further both mask and carbon paste corresponding to the zigzag shape of the resistor 22 are used in advance to form the first resistor 22*a*, the second resistor 22*b* and the third resistor 22*c* as well as the first resistance pattern 22*d* and the second resistance pattern 22*e* simultaneously at the rear surface of the movable member 21 at the same stage by a screen printing. Then, at first, the first to third slider elements 19*a* to 19*c* of the first resistor 16 are oppositely faced to the resistor 18, the movable member 17 is fitted between the hook part 15*b* and the raised wall 4 and held by the case 1, and then the first to third slider elements 22*a* to 22*c* of the second resistor 20 are oppositely faced to the resistor 22, the movable member 21 is fitted between the hook part 15*a* and the raised wall 3 and held by the case 1. Then, a clip spring 11 is stored and held in an annular protrusion 8 of the case 1, then the annular wall 25*a* is fitted to the upper end of the return spring 24, the lower end of the return spring 24 supporting the spring receptacle 25 is fitted to the annular protrusion 8, thereby the return spring 24 is fixed to the case 1.

Then, the lever member 36 is inserted from its upper end into the hole 32*a* of the second cooperating member 31, a pair of protrusions 37*a* are engaged with the fitting holes 32*b* to make a snap stop there, thereby the lever member 36 and the second cooperating member 31 are combined to make a unit. When this unit is inserted between the raised walls 3 and 5 from the free ends of the raised walls 3, 5 with the tapered surfaces 33*a*, 34*a* of the second cooperating member 31 being corresponded to the tapered surfaces 3*a*, 5*a* of the raised walls 3, 5, this unit is inserted while the tapered surfaces 33*a*, 34*a* of the second cooperating member 31 are guided by the tapered surfaces 3*a*, 5*a* and the raised walls 3, 5 are being flexed outwardly, and when the fixed portions 33, 34 pass through each of the inner wall surface of the raised wall 3 below the tapered surface 3*a* and the inner wall surface of the raised wall 5 below the tapered surface 5*a*, the raised walls 3, 5 are recovered to their original states, the fixing portions 33, 34 are inserted into and engaged with each of the engaging holes 3*b*, 5*b* of the raised walls 3, 5 resiliently recovered to an inward direction to attain a snap stopped state and they are pivotally arranged at the raised walls 3, 5.

Then, when the hole 27*a* of the first cooperating member 26 is inserted from the upper end of the lever 36 into the shaft 37 and the first cooperating member 26 is inserted between the raised walls 4, 6 from its free end side while the tapered surfaces 28*a*, 29*a* of the first cooperating member 26 are being corresponded to the tapered surfaces 4*a*, 6*a* of the raised walls 4, 6, the first cooperating member 26 is inserted while its tapered surfaces 28*a*, 29*a* are being guided by the tapered surfaces 4*a*, 6*a* of the raised walls 4, 6 and the raised walls 4, 6 are being flexed outwardly, the raised walls 4, 6 are recovered to their original states when the fixing portions 28, 29 pass through each of the inner wall surface below the tapered surface 4*a* of the raised wall 4 and the inner wall surface below the tapered surface 6*a* of the raised wall 6, the fixing portions 28, 29 are inserted into and engaged with each of the engaging holes 4*b*, 6*b* of the raised walls 4, 6 resiliently recovered inwardly and snap stopped there, they are overlapped on the second cooperating member 31 in a crossed state, and they are rotatably arranged at the raised walls 4, 6.

Assembling work for the variable resistor is completed in this way and after assembling of it, the spring receptacle 25 is abutted against the lower surfaces of the bases 27, 32 of the first and second cooperating members 26, 31, each of the fixing portions 28, 29, 33 and 34 is positioned at the upper ends of the engaging holes 4*b*, 6*b*, 3*b* and 5*b*, the lever member 36 is positioned at an initial position where its axis line 36*a* is crossed at a right angle with the bottom wall 2 of the case 1 and the pressing part 38 is abutted against the clip spring 11, and in addition, each of the movable members 17, 21 is positioned in the guide grooves 12, 13 to be faced oppositely to the case 1, each of the circular portions 30*a*, 35*a* of the first and second operating portions 30, 35 is inserted into and engaged with the engaging holes 17*a*, 21*a* of the movable members 17, 21, the first to third slider elements 23*a* to 23*c* of the first resistor 16 are in contact with the resistor 22, the terminal 23*d* and the terminal 23*f* are made conductive through the connector piece 19*e*, the first slider element 19*a*, resistor 18, the third slider element 19*c* and the connector piece 19*f*, the first to third slider elements 23*a* to 23*c* of the second resistor 20 are in contact with the resistor 22, and the terminal 23*d* and the terminal 23*f* are made conductive through the first slider element 23*a*, the resistor 22 and the slider element 23*c*.

Figure 4:
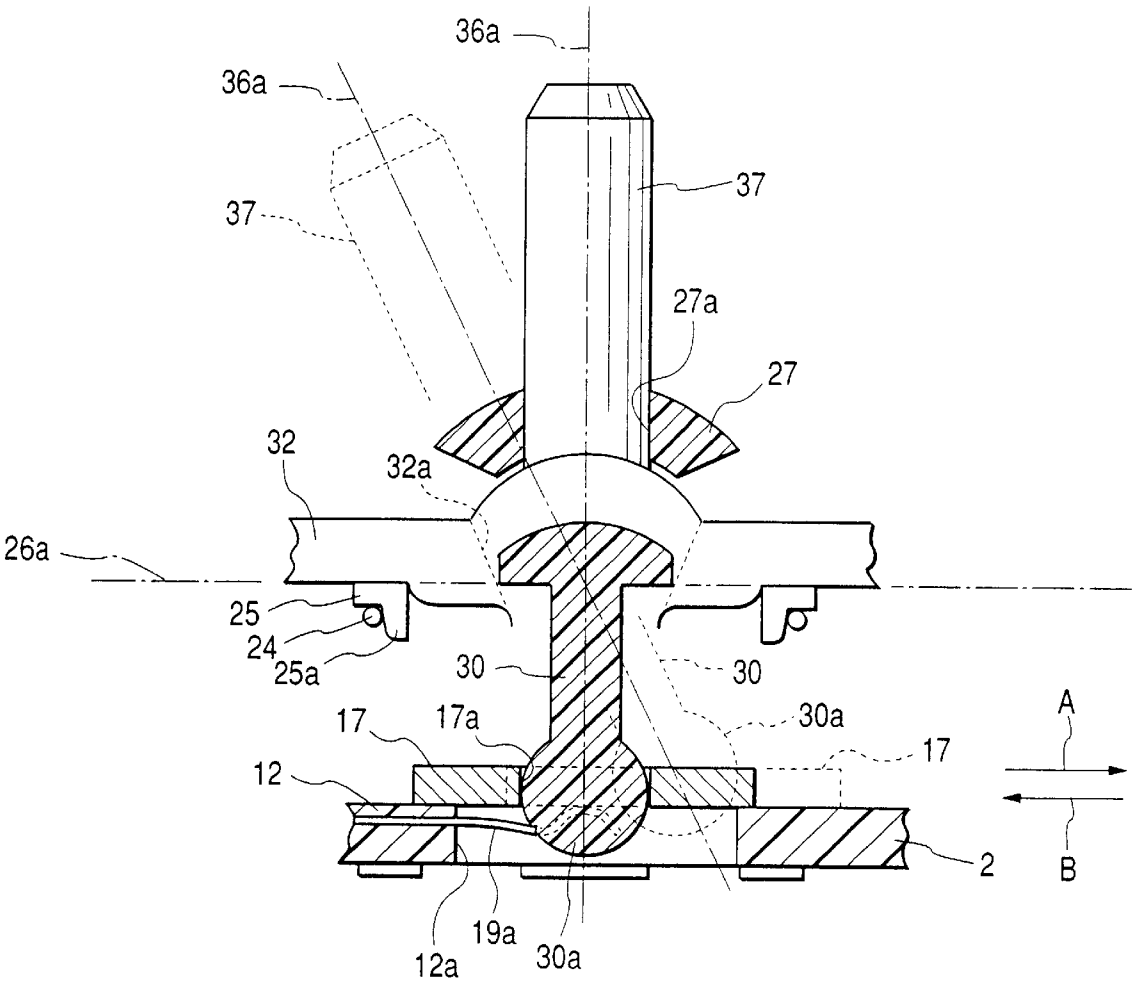
FIG. 4 is an illustrative view for showing an operation of the variable resistor of the first preferred embodiment of the present invention.

The multi-directional input device constituted and assembled as described above is used while a predetermined voltage is applied between the terminals 23*d*, 23*f* and between the terminals 9, 10, wherein if an operator inclines the shaft 37 of the lever member 36 in a direction of arrow E shown in FIG. 5, for example, the first and second cooperating members 26, 31 are turned while the shaft 37 is freely moved in the holes 27*a*, 32*a*, the spring receptacle 5 is pressed against the lower surfaces of the bases 27, 32 of the first and second cooperating members 26, 31, the first operating part 30 is integrally rotated with the base 27 of the first cooperating member 26, and the second operating part 35 is integrally rotated with the base 32 of the second cooperating member 32. Then, as shown in FIG. 4, when the shaft 37 of the lever member 36 is inclined from the initial position indicated by a solid line to the state indicated by a dotted line, the first operating member 30 is turned form the initial position indicated by a solid line to the state indicated by a dotted line, the movable member 17 engaged with the circular part 30*a* moves while each of the first to third resistors 18*a* to 18*c* of the resistor 18 is slidingly contacted with the first and third slider elements 19*a* to 19*c* along the guide groove 12 from the initial position indicated by a solid line to a position indicated by a dotted line in a direction from one end to the other end of each of the first, second and third resistors 18*a*, 18*b* and 18*c*.

As shown in FIG. 6, the sliding contact position between the resistor 18 and the extremity ends of the first to third slider elements 19*a* to 19*c* becomes a position P1 where it is moved from an initial position P0 along with the movement of the movable member 17, a resistance value between the first and second slider elements 19*a*, 19*b* is decreased and at the same time a resistance value between the second and. third slider elements 19*b*, 19*c* is increased, the first resistor 16 detects the turning of the first operating member 30, the electrical signal generating part formed by the first to third slider elements 19*a* to 19*c* and by the resistor 18 generates an electrical signal (a voltage signal) corresponding to a variation in this resistance value, and this electrical signal is taken out between either the terminal 23*d* or the terminal 23*f* and the terminal 19*d* through either the first slider element 19*a* or the third slider element 19*c* and the second slider element 19*b*. Since a resistance value between the second and third slider elements 19*b*, 19*c* is increased only by a reduced amount of resistance value between the first and second slider elements 19*a*, 19*b*, a resistance value between the first and third slider elements 19*a*, 19*c* is kept constant, and a linear output proportional to an amount of motion of the movable member 17 is outputted from between the terminal 19*d* and either the terminal 23*d* or the terminal 23*f*.

Similarly, under the turning operation of the second operating part 31 along with the inclination of the lever member 36 toward the direction indicated by an arrow E, the operating member 21 engaged with the circular part 35*a* is moved in a direction (the direction indicated by the arrow C) from one end to the other end of each of the first, second and third resistors 22*a*, 22*b* and 22*c* while the resistor 22 is slidingly contacted with the first to third slider elements 23*a* to 23*c* along the guide groove 13. As shown in FIG. 7, the sliding contact position between the resistor 22 and the extremity ends of the first to third slider elements 23*a* to 23*c* is a position S1 where it is moved from an initial position S0, a resistance value between the first and second slider elements 23*a*, 23*b* is decreased and at the same time a resistance value between the second and third slider elements 23*b*, 23*c* is increased, and the second resistor 20 detects the turning of the second operating member 35. The electrical signal generating part formed by the first to third slider elements 23*a* to 23*c* and by the resistor 22 generates an electrical signal (a voltage signal) corresponding to a variation in this resistance value, and this electrical signal is taken out between either the terminal 23*d* or the terminal 23*f* and the terminal 23*e* through either the first slider element 23*a* or the third slider element 23*c* and the second slider element 23*b*. Also in this case, a linear output proportional to an amount of motion of the operating member 17 is similarly outputted from between the terminal 23*e* and either the terminal 23*d* or the terminal 23*f*.

In addition, as the inclination operating force for the lever 36 is released, the spring receptacle 25 is pushed back upwardly with a recovering force of the return spring 24, the first and second cooperating members 26, 31 are turned, and through this turning operation, the lever member 36 is returned back to the raising-up initial position while it is freely moved in the holes 27*a*, 32*a* and at the same time each of the first and second operating parts 30, 35 is turned in a direction opposite to that described above together with the movable members 17, 21 and returns back to the initial position.

At this time, the movable member 17 is moved in a direction (the direction indicated by the arrow B) from the other end to one end of each of the first, second and third resistors 18*a*, 18*b* and 18*c* while the resistor 18 is slidingly contacted with the first to third slider elements 19*a* to 19*c* along the guide groove 12. As shown in FIG. 6, a slide contact position between the resistor 18 and each of the extremity ends of the first to third slider elements 18*a* to 18*c* is changed from the moving position P1 to the initial position P0, a resistance value between the first and second slider elements 19*a*, 19*b* is increased and at the same time a resistance value between the second and third slider elements 19*b*, 19*c* is decreased. The first resistor 16 detects the turning operation of the first operating member 16, the electrical signal generating part formed by the first to third slider elements 19*a* to 19*c* and the resistor 18 may generate an electrical signal (a voltage signal) This electrical signal is taken out between either the terminal 23*d* or terminal 23*f* and the terminal 19*d* through either the first slider element 19*a* or the third slider element 19*c* and the second slider element 19*b*. Further, since a resistance value between the second and third slider elements 19*b*, 19*c* is decreased only by an increased resistance value between the first and second slider elements 19*a*, 19*b*, a resistance value between the first and third slider elements 19*a*, 19*c* is kept constant and a linear output proportional to a moving amount of the movable member 17 is outputted from between the terminal 19*d* and either the terminal 23*d* or the terminal 23*f*.

Similarly, under the turning operation of the second operating member 31 returning back to the initial position, the movable member 21 is moved in a direction (the direction indicated by the arrow D) from the other end to one end of each of the first, second and third resistors 22*a*, 22*b* and 22*c* while the resistor 22 is slidingly contacted with the first to third slider elements 23*a* to 23*c* along the guide groove 13. As shown in FIG. 7, a slide contact position between the resistor 22 and each of the extremity ends of the first to third slider elements 23*a* to 23*c* is changed from the moving position S1 to the initial position S0, a resistance value between the first and second slider elements 23*a*, 23*b* is increased and at the same time a resistance value between the second and third slider elements 23*b*, 23*c* is decreased. The second resistor 20 detects the turning operation of the second operating member 35, the electrical signal generating part formed by the first to third slider elements 23*a* to 23*c* and the resistor 22 may generate an electrical signal (a voltage signal) corresponding to the variation of this resistance value, and this electrical signal is taken out between either the terminal 23*d* or terminal 23*f* and the terminal 23*e* through either the first slider element 23*a* or the third slider element 23*c* and the second slider element 23*b*. Also in this case, a linear output proportional to an amount of motion of the operating member 21 is outputted from between the terminal 23*e* and either the terminal 23*d* or the terminal 23*f* in the same manner as that for the resistor 18.

In turn, when an operator presses down the shaft 37 of the lever member 36, a pair of protrusions 37*a* are guided by the fitting hole 32*b* and slid in a direction of an axis line 36*a*, thereby the lever member 36 descends, the pressing part 38 pushes the click spring 11 to cause the click spring 11 to be reversed and contacted with a fixed contact point 9*a*. With such an arrangement as above, a click feeling is generated, a conductive state is produced between the fixed contact point 9*a* and the contact point 10*a* and between the fixed contact point 9*a* and the contact point 10*b* by the click spring 11, the push button switch is turned on and then a switch-on signal is outputted from either the terminal 9 or the terminal 10.

In addition, if the pressing operation force against the lever member 36 is released under this state, the click spring 11 is returned back to its original dome-shape by its own reversing recovering force, so that the pressing part 38 is pushed up by this click spring 11 to cause the lever member 36 to be returned back to the initial position, thereby the click spring 11 is moved away from the fixed contact point 9*a*, resulting in that a switched-off state is attained in which the conductive state between the fixed contact point 9*a* and the contact point 10*a* and between the fixed contact point 9*a* and the contact point 10*b* is released. Accordingly, in addition to an output of the electrical signal caused by the inclination of the lever member 36, the lever member 36 is pressed and operated to enable a switch-on signal to be outputted.

Figure 8:
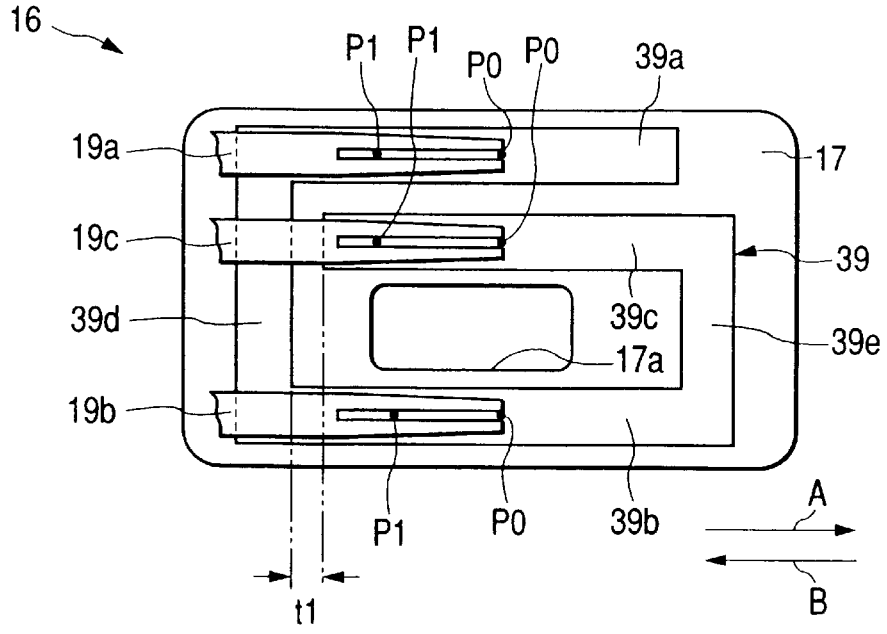
FIG. 8 is a rear view for showing the first resistor of the second preferred embodiment of the present invention.

Referring now to FIG. 8, a second preferred embodiment of the variable resistor of the present invention will be described.

Differences between the first preferred embodiment and the second preferred embodiment of the present invention only consist in the facts that a shape of the resistor 18 of the first resistor 16 is changed to form a resistor 39 and the arrangement of the first to third slider elements 19*a* to 19*c* in the first resistor 16 is changed in compliance with this modification and the remaining portions are similar to those of the first preferred embodiment.

The resistor 39 shown in FIG. 8 is constituted by the first, second and third resistors 39*a*, 39*b* and 39*c* and the first and second resistance patterns 39*d*, 39*e* formed at the rear surface of the movable member 17 by the same carbon paste in the same width. The first and third resistors 39*a*, 39*c* are arranged side-by-side in a direction crossing at a right angle with a reciprocating moving direction (directions of arrows A and B) of the movable member 17, and they are formed in parallel along the second resistor 39*b*. The third resistor 39*c* is arranged between the first and second resistors 39*a*, 39*b* and formed to the same length as that of the third resistor 18*c* illustrated in the first preferred embodiment. Then, in order to avoid a contact with the first resistance pattern 39*d*, the third resistor 39*c* is arranged with a certain clearance (t1) being left between it and the first resistance pattern 39*d*. Due to this fact, the resistor 39 has a length in the reciprocating direction of the movable member 17 longer by the clearance (t1) as compared with that of the resistor 18 of the first preferred embodiment.

In the case of the second preferred embodiment constituted in this way, when an operator inclines the shaft 37 of the lever member 36 in a direction of the arrow E shown in FIG. 5, for example, in the same manner as that of the first preferred embodiment, the operating member 17 engaged with the circular part 30*a* is moved in a direction from one end side to the other end side of each of the first, second and third resistors 39*a*, 39*b* and 39*c* (the direction of the arrow A) while the resistor 39 is slidingly contacted with the first to third slider elements 19*a* to 19*c* along the guide groove 12. As shown in FIG. 8, a slide contact position between the resistor 39 and each of the extremity ends of the first to third slider elements 19*a* to 19*c* is changed from the initial position P0 to the moved position P1, a resistance value between the first and second slider elements 19*a*, 19*b* is decreased and at the same time a resistance value between the second and third slider elements 19*b*, 19*c* is increased. The first resistor 16 detects the turning operation of the first operating member 30, the electrical signal generating part formed by the first to third slider elements 19*a* to 19*c* and the resistor 39 may generate an electrical signal (a voltage signal) corresponding to the variation of this resistance value. This electrical signal is taken out between either the terminal 23*d* or terminal 23*f* and the terminal 19*d* through either the first slider element 19*a* or the third slider element 19*c* and the second slider element 19*b*. Since a resistance value between the second and third slider elements 19*b*, 19*c* is increased only by a decreased amount of a resistance value between the first and second slider elements 19*a*, 19*b*, a resistance value between the first and third slider elements 19*a*, 19*c* is kept constant, and a linear output proportional to an amount of motion of the movable member 17 is outputted from between the terminal 19*d* and either the terminal 23*d* or the terminal 23*f*.

Further, when an operator releases an inclination operation of the lever member 36 in the same manner as that of the first preferred embodiment, the movable member 17 is moved in a direction (the direction of the arrow B) from the other end side to one end side of each of the first, second and third resistors 39*a*, 39*b* and 39*c* while the resistor 39 is slidingly contacted with the first to third slider elements 19*a* to 19*c* along the guide groove 12. As shown in FIG. 8, a slide contact position between the resistor 39 and each of the extremity ends of the first to third slider elements 19*a* to 19*c* is changed from the moved position P1 to the initial position P0, a resistance value between the first and second slider elements 19*a*, 19*b* is increased and at the same time a resistance value between the second and third slider elements 19*b*, 19*c* is decreased. The first resistor 16 detects the turning operation of the first operating member 30, the electrical signal generating part formed by the first to third slider elements 19*a* to 19*c* and the resistor 39 may generate an electrical signal (a voltage signal) corresponding to the variation of this resistance value, and this electrical signal is taken out between either the terminal 23*d* or terminal 23*f* and the terminal 19*d* through either the first slider element 19*a* or the third slider element 19*c* and the second slider element 19*b*. Since a resistance value between the second and third slider elements 19*b*, 19*c* is decreased only by an increased amount of a resistance value between the first and second slider elements 19*a*, 19*b*, a resistance value between the first and third slider elements 19*a*, 19*c* is kept constant, and a linear output proportional to an amount of motion of the movable member 17 is outputted from between the terminal 19*d* and either the terminal 23*d* or the terminal 23*f*.

Although this second preferred embodiment has been illustrated in reference to the case that the present invention is applied to the first resistor 16, the present invention can be similarly applied to the second resistor 20 and it is also possible to apply it to both the first and second resistors 16, 20.

Figure 9:
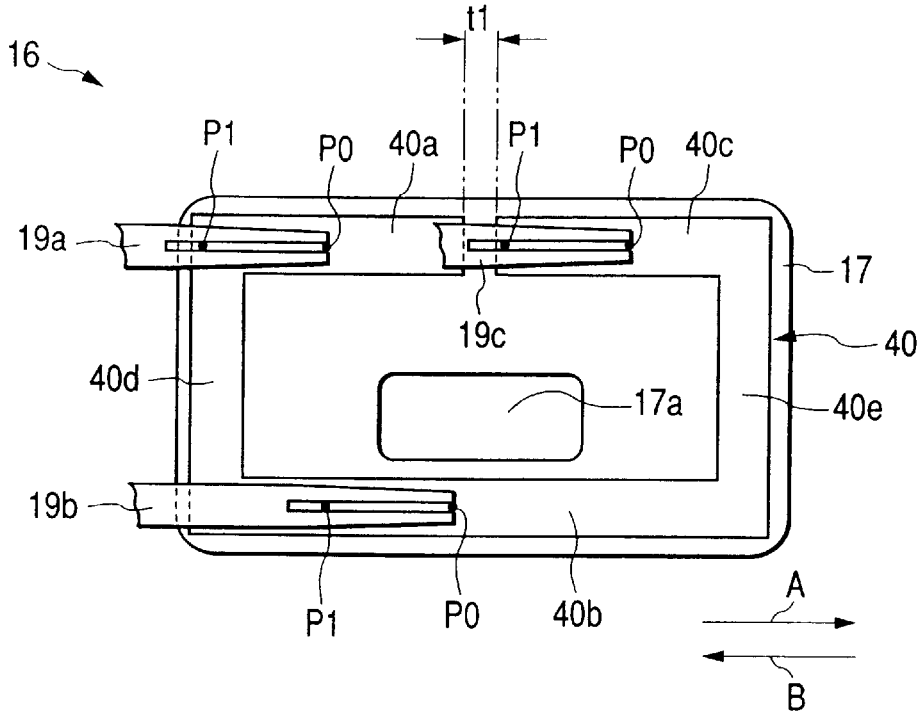
FIG. 9 is a rear view for showing the first resistor of the third preferred embodiment of the present invention.

Referring now to FIG. 9, the third preferred embodiment of the variable resistor of the present invention will be described as follows.

Differences between the first preferred embodiment and the third preferred embodiment of the present invention only consist in the facts that a shape of the resistor 18 of the first resistor is changed to form a resistor 40 and the arrangement of the first to third slider elements 19*a* to 19*c* in the first resistor 16 is changed in compliance with this modification and the remaining portions are similar to those of the first preferred embodiment.

The resistor 40 shown in FIG. 9 is constituted by the first, second and third resistors 40*a*, 40*b* and 40*c* and the first and second resistance patterns 40*d*, 40*e* formed at the rear surface of the movable member 17 by the same carbon paste in the same width, the first and third resistors 40*a*, 40*c* are arranged side-by-side with a clearance (t1) on a linear line in reciprocating directions (directions of arrows A and B) of the movable member 17, they are formed in parallel along the second resistor 40*b*. Due to this fact, the resistor 40 has a length in the reciprocating direction of the movable member 17 longer by the clearance (t1) between the third and the first resisters 40*c* and 40*a* as compared with that of the resistors 18 and 39 of the first and second preferred embodiments.

In the case of the third preferred embodiment constituted in this way, when an operator inclines the shaft 37 of the lever member 36 in a direction of the arrow E shown in FIG. 5, for example, in the same manner as that of the first preferred embodiment, the operating member 17 engaged with the circular part 30*a* is moved in a direction from one end side to the other end side of each of the first, second and third resistors 40*a*, 40*b* and 40*c* (the direction of the arrow A) while the resistor 40 is slidingly contacted with the first to third slider elements 19*a* to 19*c* along the guide groove 12. As shown in FIG. 9, a slide contact position between the resistor 40 and each of the extremity ends of the first to third slider elements 19*a* to 19*c* is changed from the initial position P0 to the moved position P1, a resistance value between the first and second slider elements 19*a*, 19*b* is decreased and at the same time a resistance value between the second and third slider elements 19*b*, 19*c* is increased. The first resistor 16 detects the turning operation of the first operating member 30, the electrical signal generating part formed by the first to third slider elements 19*a* to 19*c* and the resistor 40 may generate an electrical signal (a voltage signal) corresponding to the variation of this resistance value, and this electrical signal is taken out between either the terminal 23*d* or terminal 23*f* and the terminal 19*d* through either the first slider element 19*a* or the third slider element 19*c* and the second slider element 19*b*. Since a resistance value between the second and third slider elements 19*b*, 19*c* is increased only by a decreased amount of a resistance value between the first and second slider elements 19*a*, 19*b*, a resistance value between the first and third slider elements 19*a*, 19*c* is kept constant, and a linear output proportional to an amount of motion of the movable member 17 is outputted from between the terminal 19*d* and either the terminal 23*d* or the terminal 23*f*.

Further, when an operator releases an inclinating operation of the lever member 36 in the same manner as that of the first preferred embodiment, the movable member 17 is moved in a direction (the direction of the arrow B) from the other end side to one end side of each of the first, second and third resistors 40*a*, 40*b* and 40*c* while the resistor 40 is slidingly contacted with the first to third slider elements 19*a* to 19*c* along the guide groove 12. As shown in FIG. 9, a slide contact position between the resistor 40 and each of the extremity ends of the first to third slider elements l9*a* to 19*c* is changed from the moved position P1 to the initial position P0, a resistance value between the first and second slider elements 19*a*, 19*b* is increased and at the same time a resistance value between the second and third slider elements 19*b*, 19*c* is decreased. The first resistor 16 detects the turning operation of the first operating member 30, the electrical signal generating part formed by the first to third slider elements 19*a* to 19*c* and the resistor 40 may generate an electrical signal (a voltage signal) corresponding to the variation of this resistance value, and this electrical signal is taken out between either the terminal 23*d* or terminal 23*f* and the terminal 19*d* through either the first slider element 19*a* or the third slider element 19*c* and the second slider element 19*b*. Since a resistance value between the second and third slider elements 19*b*, 19*c* is decreased only by an increased amount of a resistance value between the first and second slider elements 19*a*, 19*b*, a resistance value between the first and third slider elements 19*a*, 19*c* is kept constant, and a linear output proportional to an amount of motion of the movable member 17 is outputted from between the terminal 19*d* and either the terminal 23*d* or the terminal 23*f*.

Although this third preferred embodiment has been illustrated in reference to the case that the present invention is applied to the first resistor 16, the present invention can be similarly applied to the second resistor 20 and it is also possible to apply it to both the first and second resistors 16, 20.

Figure 10:
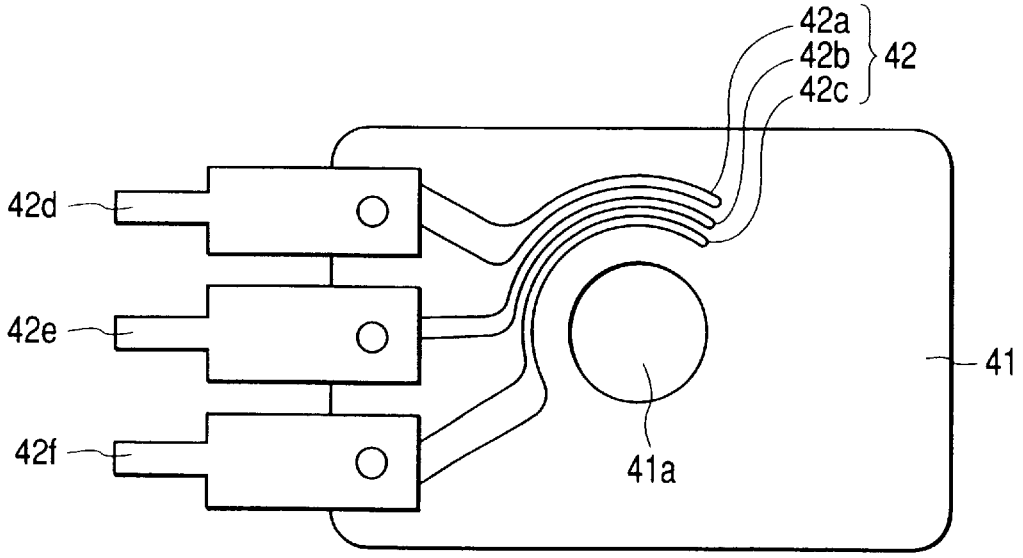
FIG. 10 is a top plan view for showing a print circuit board for a variable resistor of a fourth preferred embodiment of the present invention.
Figure 11:
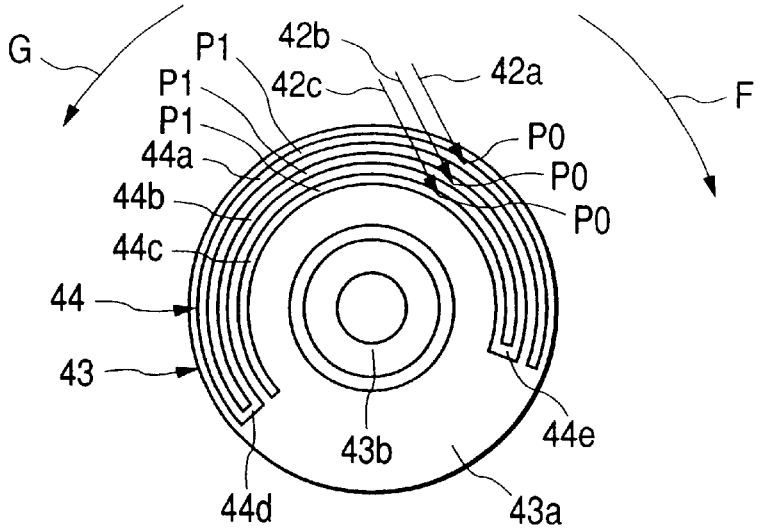
FIG. 11 is a rear view for showing a movable member of a variable resistor of a fourth preferred embodiment of the present invention.
Figure 12:
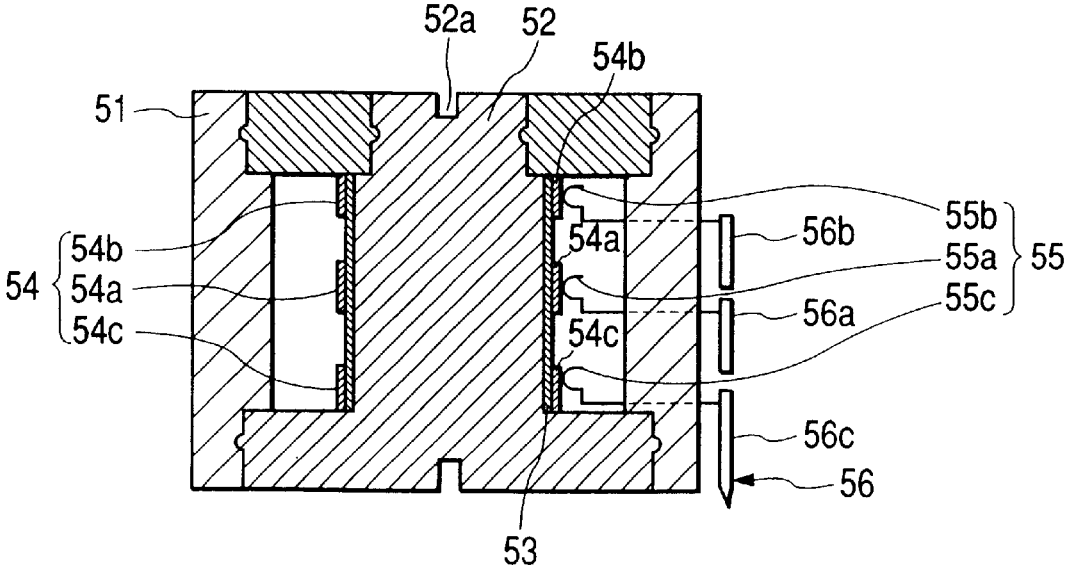
FIG. 12 PRIOR ART
FIG. 12 is a sectional view for showing the prior art variable resistor.
Figure 13:
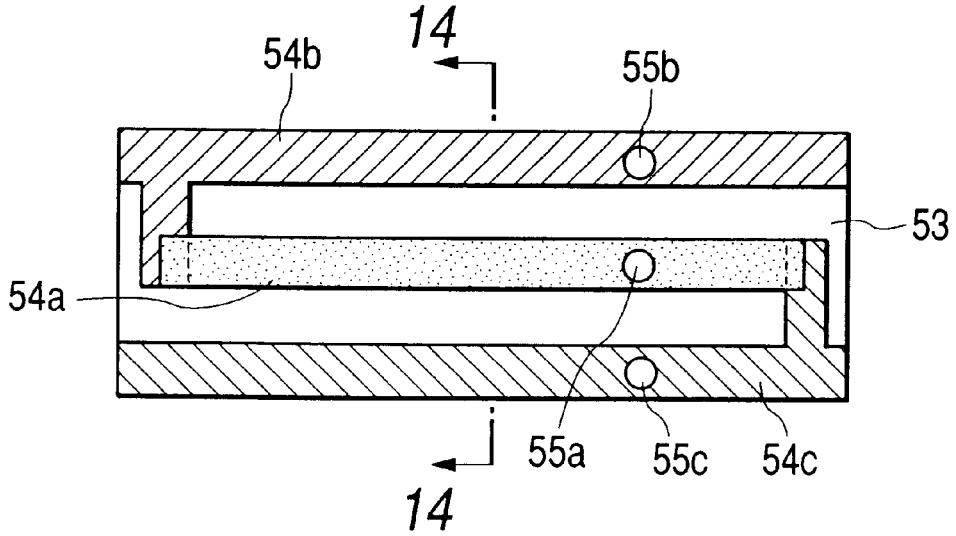
FIG. 13 PRIOR ART
FIG. 13 is a development view for showing a flexible insulating sheet of the prior art variable resistor.
Figure 14:
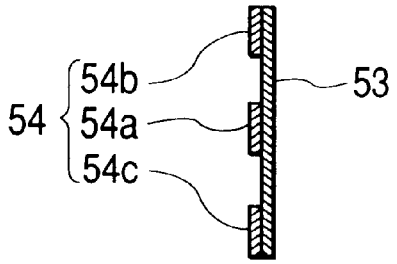
FIG. 14 PRIOR ART

Referring now to FIGS. 10 and 11, the fourth preferred embodiment of the variable resistor of the present invention will be described as follows.

As shown in FIG. 10, a slider element 42 is fixed to a printed circuit board 41 formed with a shaft receiving hole 41*a*. The slider element 42 is constituted by the first, second and third slider elements 42*a*, 42*b*, 42*c* formed by a conductive thin plate, and each of the terminals 42*d*, 42*e* and 42*f* is fed out of the rear ends of these first, second and third slider elements 42*a*, 42*b* and 42*c*, respectively.

FIG. 11 illustrates a movable member 43 opposingly in contact with the printed circuit board 41, the movable member 43 is comprised of a disk-like insulating base plate 43*a*, and a cylindrical shaft 43*b* vertically installed at the central part of the insulating base plate 43*a*. The cylindrical shaft 43*b* is fitted to the bearing hole 41*a* and rotatably attached to the printed circuit board 41 and it can be reciprocated in both clockwise direction and counter-clockwise direction. A resistor 44 is formed at the rear surface of the insulating base plate 43*a*, the resistor 44 has a series of the first, second and third resistors 44*a*, 44*b* and 44*c* electrically independent from each other in which each of the extremity ends of the first, second and third slider elements 42*a*, 42*b* and 42*c* is slidingly contacted with each other and they are extending in an arcuate manner in the reciprocating directions (the directions indicated by arrows F, G) of the movable member 43; the first resistance pattern 44*d* having one end of each of the first and second resistors 44*a*, 44*b* connected to each other; and the second resistance pattern 44*e* having the other end opposite to one end of the third resistor 44*c* connected to the other end of the second resistor 44*b*, wherein these first, second and third resistors 44*a*, 44*b*, 44*c* and the first and second resistance patterns 44*d*, 44*e* are formed by the same carbon paste in the same width from each other. Then, the first and third resistors 44*a*, 44*c* are arranged side-by-side in a direction (a radial direction) crossing at a right angle with the reciprocating directions of the movable member 43, faced oppositely with the second resistor 44*b* being held therebetween and they are formed in parallel with each other along the second resistor 44*b*.

In the case of the fourth preferred embodiment of the present invention constituted as described above, when an operator turns the movable member 43 in a direction (the direction of the arrow F) from one end to the other end of each of the first, second and third resistors 44*a*, 44*b* and 44*c* under a state in which a predetermined voltage is applied between the terminals 42*d*, 42*f*, the sliding contact positions among the first to third resistors 44*a* to 44*c* and the first to third slider elements 42*a* to 42*c* is changed from the initial position P0 to the moved position P1. A resistance value between the first and second slider elements 42*a*, 42*b* is decreased and at the same time a resistance value between the second and third slider elements 42*b*, 42*c* is increased. The electrical signal generating part formed by the first to third slider elements 42*a* to 42*c* and the resistor 44 may generate an electrical signal (a voltage signal) corresponding to the variation of this resistance value, and this electrical signal is taken out between either the terminal 42*d* or terminal 42*f* and the terminal 42*e* through either the first slider element 42*a* or the third slider element 42*c* and the second slider element 42*b*. Since a resistance value between the second and third slider elements 42*b*, 42*c* is increased only by a decreased amount of a resistance value between the first and second slider elements 42*a*, 42*b*, a resistance value between the first and third slider elements 42*a*, 42*c* is kept constant, and a linear output proportional to an amount of motion of the movable member 43 is outputted from between the terminal 42*e* and either the terminal 42*d* or the terminal 42*f*.

In addition, when an operator turns the movable member 43 in a direction (the direction of the arrow G) from the other end to one end of each of the first, second and third resistors 44*a*, 44*b* and 44*c*, the sliding contact positions among the first to third resistors 44*a* to 44*c* and the first to third slider elements 42*a* to 42*c* is changed from the moved position P1 to the original initial position P0, a resistance value between the first and second slider elements 42*a*, 42*b* is increased and at the same time a resistance value between the second and third slider elements 42*b*, 42*c* is decreased. The electrical signal generating part formed by the first to third slider elements 42*a* to 42*c* and the resistor 44 may generate an electrical signal (a voltage signal) corresponding to the variation of this resistance value, and this electrical signal is taken out between either the terminal 42*d* or terminal 42*f* and the terminal 42*e* through either the first slider element 42*a* or the third slider element 42*c* and the second slider element 42*b*. Since a resistance value between the second and third slider elements 42*b*, 42*c* is decreased only by an increased amount of a resistance value between the first and second slider elements 42*a*, 42*b*, a resistance value between the first and third slider elements 42*a*, 42*c* is kept constant, and a linear output proportional to an amount of motion of the movable member 43 is outputted from between the terminal 42*e* and either the terminal 42*d* or the terminal 42*f*.

As described above, the resistor 39 of the second preferred embodiment is made such that the first and third resistors 39*a*, 39*c* are arranged side-by-side in a direction crossing at a right angle with a reciprocating direction of the movable member 17 and arranged in parallel to each other along the second resistor 39*b*, so that a length of the movable member 17 in its reciprocating direction is short as compared with that of the resistor 40 in the third preferred embodiment. Accordingly, it is possible to reduce the size of the movable member 17 in its reciprocating direction in compliance with it and further it is possible to attain a small-sized variable resistor.

In addition, the resistor 18 shown in the first preferred embodiment is made such that the first and third resistors 18*a*, 18*c* are arranged oppositely with the second resistor 18*b* being held therebetween, so that the length of the movable member 17 in its reciprocating direction is shorter by an amount of the clearance (t1) as compared with that of the resistor 39 in the second preferred embodiment. Accordingly, the size of the movable member 17 in its reciprocating direction can be reduced correspondingly and further it is possible to attain a smaller-sized variable resistor. Thus, this situation can be similarly applied to the resistor 44 illustrated in the fourth preferred embodiment.

In addition, in the case of the first, second and third preferred embodiments above, the first operating part 30 is protruded in a direction crossing at a right angle with a line 26*a* connecting the rotating centers of both fixing portions 28, 29 of the first cooperating member 26 within a region enclosed by the inner four raised walls 3 to 6 of the four raised walls to 6, the second operating part 35 is protruded in a direction crossing at a right angle with a line 31*a* connecting the rotating centers of both fixing portions 33, 34 of the second cooperating member 31 within a region enclosed by the inner four raised walls 3 to 6 of the four raised walls 3 to 6, the first and second resistors 16, 20 are arranged there and the turning operations of the first and second operating portions 30, 35 are detected by the first and second resistors 16, 20, so that it is possible to reduce the size of the variable resistor in the direction where the line 26*a* extends and the direction where the line 31*a* extends and also to attain a small-sized resistor.

What is claimed is:

1. A variable resistor comprising:

a resistor formed at a movable member arranged to be reciprocatable; and a slider element attached to a fixing member fixed in opposition to said movable member, slidingly contacted with said resistor to form an electrical signal generating part together with said resistor;

wherein said resistor has a first resistor, a second resistor and a third resistor extending in a reciprocating direction of said movable member and electrically independent from each other, a first resistor pattern having one end of each of said first resistor and said second resistor connected to each other, a second resistor pattern having the other end opposite to one end of said third resistor connected to the other end of said second resistor; said slider element is comprised of a first slider element, a second slider element and a third slider element slidingly contacted with said first resistor, said second resistor and said third resistor; the first, second and third slider elements are set such that when the first, second and third slider elements slide on said first, second and third resistors through reciprocating motion of said movable member and said movable member moves in a direction from one end to the other end of each of said first, second and third resistors, a the resistance value between said first and second slider elements is increased and a resistance value between said second slider element and said third slider element is decreased, and in turn when said movable member is moved in a direction from the other end to one end of each of said first, second and third resistors, the resistance value between said first slider element and said second slider element is decreased and the resistance value between said second slider element and said third slider element is increased.

2. A variable resistor according to claim 1, wherein said first and said third resistors are arranged side-by-side in a direction crossing at a right angle with the reciprocating direction of said movable member and formed in parallel along said second resistor.

3. A variable resistor according to claim 2, wherein said first and third resistors are arranged oppositely with said second resistor being held therebetween.

4. A variable resistor according to claim 1, wherein said first, second and third resistors and said first and second resistor patterns are integrally formed.

* * * * *

UNITED STATES PATENT AND TRADEMARK OFFICE

CERTIFICATE OF CORRECTION

PATENT NO. : 6,239,688 B1
DATED : May 29, 2001
INVENTOR(S) : Kisaburo Takahashi et al.

It is certified that error appears in the above-identified patent and that said Letters Patent is hereby corrected as shown below:

Column 16,
Line 45, delete "the" after "a".

Signed and Sealed this

Twenty-eighth Day of May, 2002

*Attest:*

*Attesting Officer*

JAMES E. ROGAN
*Director of the United States Patent and Trademark Office*